US011369161B2

(12) United States Patent
Crary et al.

(10) Patent No.: US 11,369,161 B2
(45) Date of Patent: Jun. 28, 2022

(54) SLIP RESISTANT EXPANSION OVERSHOE

(71) Applicant: Shoes For Crews, LLC, Boca Raton, FL (US)

(72) Inventors: Nathan Crary, Lake Oswego, OR (US); Kyle Pulli, La Jolla, CA (US)

(73) Assignee: Shoes For Crews, LLC, Boca Raton, FL (US)

( * ) Notice: Subject to any disclaimer, the term of this patent is extended or adjusted under 35 U.S.C. 154(b) by 87 days.

(21) Appl. No.: 16/804,256

(22) Filed: Feb. 28, 2020

(65) Prior Publication Data

US 2020/0275732 A1 Sep. 3, 2020

Related U.S. Application Data

(60) Provisional application No. 62/811,860, filed on Feb. 28, 2019.

(51) Int. Cl.

| | |
|---|---|
| ***A43B 3/16*** | (2022.01) |
| ***A43B 13/22*** | (2006.01) |
| ***A43B 1/00*** | (2006.01) |

(52) U.S. Cl.

CPC ..... *A43B 3/16* (2013.01); *A43B 1/0018* (2013.01); *A43B 13/223* (2013.01)

(58) Field of Classification Search

CPC ..... A43B 1/0018; A43B 3/16; A43B 3/163; A43B 3/18; A43B 3/248; A43B 3/26; A43B 5/18; A43B 5/185; A43B 13/16; A43B 13/223

USPC ..... 36/97

See application file for complete search history.

(56) References Cited

U.S. PATENT DOCUMENTS

| | | | | |
|---|---|---|---|---|
| 4,497 | A * | 5/1846 | Vetter | A43B 11/00 36/7.1 R |
| 3,026,635 | A * | 3/1962 | Slade | A43B 3/16 36/7.3 |
| 3,717,943 | A | 2/1973 | Orndorff, Jr. | |
| 4,202,116 | A | 5/1980 | Dassler | |
| 4,274,211 | A | 6/1981 | Funck | |
| 6,189,239 | B1 * | 2/2001 | Gasparovic | A43B 3/30 36/102 |
| 6,519,876 | B1 * | 2/2003 | Geer | A43B 1/0081 36/102 |
| 7,047,672 | B2 | 5/2006 | Hoffer et al. | |
| 7,703,221 | B2 | 4/2010 | Richards et al. | |
| 7,818,900 | B2 * | 10/2010 | Cavasin | A43B 5/1608 36/97 |

(Continued)

FOREIGN PATENT DOCUMENTS

CN 2442539 Y 8/2001

*Primary Examiner* — Ted Kavanaugh
(74) *Attorney, Agent, or Firm* — McHale & Slavin, P.A.

(57) ABSTRACT

A slip resistant overshoe allowing expansion between a toe section and a heel section to allow a variety of shoe sizes and types to be inserted. The overshoe is formed from a sole having a flexible shank connected to an upper member. The upper member includes a front section and a rear section with opposing side sections therebetween. Each of the opposing side sections and flexible shank includes a corrugated shape to allow expansion of a distance between the front and rear section; a flatter surface resulting in greater slip resistance. Channels formed along a toe section and heel section expand and contract to expel debris providing an anti-clog function to maintain material slip resistance of the overshoe.

10 Claims, 6 Drawing Sheets

(56) References Cited

U.S. PATENT DOCUMENTS

| | | | |
|---|---|---|---|
| 8,322,050 | B2 | 12/2012 | Lubart |
| 2009/0188132 | A1 | 7/2009 | Fujikawa et al. |
| 2009/0241369 | A1 | 10/2009 | Votolato |
| 2012/0124865 | A1 | 5/2012 | Opie et al. |
| 2015/0128455 | A1 | 5/2015 | Lubart |
| 2016/0309832 | A1 | 10/2016 | Weaver |

* cited by examiner

SLIP RESISTANT EXPANSION OVERSHOE

PRIORITY CLAIM

This application claims the priority date of U.S. Provisional Patent Application No. 62/811,860 filed Feb. 28, 2019, and entitled "SLIP RESISTANT EXPANSION OVERSHOE," the contents of which are incorporated herein by reference.

FIELD OF THE INVENTION

The present invention relates generally to footwear, and in particular, to an expansion overshoe with improved slip resistance.

BACKGROUND OF THE INVENTION

Footwear is intended to protect the human foot during various activities. A few popular categories of footwear may be generalized as athletic, casual, dress, or work shoes. Footwear within each category may be designed to address conditions of the human foot or the environment for which the footwear is worn. For example, certain conditions may include orthopedic shoes or dress shoes, while environmental conditions may dictate the need for waterproof shoes or shoes having soles capable of traversing slippery surfaces. Materials of construction for footwear vary, but most commonly are directed to leather, canvas, or petrochemical derived materials.

The footwear categories and conditions that an individual may encounter lead to a countless variety of shoes which can be manufactured. Unfortunately, a shoe manufacture cannot predict every condition a consumer may encounter, so it is commonplace that footwear created for a particular condition is subjected to another condition. For instance, a dress shoe constructed from a leather upper member and leather sole is designed for indoor formal use; such a shoe can be ruined quickly if the individual steps in a water puddle or the like damp conditions. Another dress shoe may be constructed from a leather upper member and rubber sole to handle damp conditions, but, unless the correct rubber sole material is employed, the sole may create a most dangerous condition should the individual attempt to traverse oil or grease covered surfaces.

A consumer may like a particular shoe due to its ornamental styling or comfort, but is likely to find that same shoe can be outright dangerous on slippery surfaces. For instance, an athletic walking shoe is known to provide a comfortable platform and may appear to have a non-slip surface. However, the outsole of a conventional walking shoe may amplify the slickness of a surface, enhancing the possibility of the individual falling.

It is well known in the industry that service personnel working in restaurants are subjected to slippery floors due to food spillage, grease/oil spillage, and so forth. Should service personnel be wearing improper footwear, an individual can slip and fall. Restaurant owners that care for their employees and realize the liability associated with such an environment will require the employees to wear slip resistant shoes. The Applicant is a leader in the industry for providing specialty shoe materials and treads designed specifically for extremely slippery areas, such as restaurants. U.S. Pat. No. 8,322,050, issued to the present inventor, discloses a slip resistant outsole that includes chevron shaped treads for channeling water and grease away from the ground engaging treads. However, there will always be instances where an individual chose to wear footwear that is not designed for the slippery situation that may be encountered. Reasons can vary, such as the individual has feet with special needs, or simply the individual places design before function.

The use of an overshoe is known in the art. An overshoe allows an individual to wear a shoe of their liking, yet provide an outsole capable of providing traction on slick surfaces. A common overshoe is used to protect footwear when worn in snow/slush conditions. An overshoe also provides the ability to adapt to various sizes, types and styles of shoes. However, a common complaint of overshoes is the difficulty in placing over a shoe, especially an overshoe capable of protecting various shoe sizes. Further, many shoes may have inert non-slip tendencies formed in the sole despite the upper being unable to withstand wet conditions. Use of an overshoe is beneficial to protect the upper, but the non-slip sole makes installing an overshoe difficult.

Many different shoe soles have been proposed to prevent an individual from slipping. U.S. Pat. No. 8,322,050 discloses a footwear sole having a plurality of tread members formed thereon. The tread members include projections or lugs of various sizes and shapes which are grouped together into specific patterns. The material from which the projections are formed increases the shoe sole's ability to resist slipping on floor surfaces which are covered with oil, water, soap, etc. The shape and pattern of the projections or lugs enable them to resist flexing and disengaging the floor surface, which increases the footwear sole's ability to resist slipping.

In U.S. Pat. No. 3,717,943, the sole of a boot or overshoe is made from rubber and includes fins and grooves. The fins cooperate with the grooves to trap air within the grooves. The air facilitates the self cleaning feature of the boots, which removes mud and other substances from the soles of the boots.

U.S. Pat. No. 4,202,116 discloses a tread for a sport shoe which includes a sole having projections extending outwardly from a tread surface. The tread includes a one-piece, thin walled, metal part with at least two separate, dimensionally reinforced surface sections bearing the integrally molded projections. The reinforced surface includes a plurality of embossed, smooth-surfaced and beveled projections. The metal part is fixedly secured to an inner surface of the shoe sole by either a thin wire grid embedded in the synthetic resin sole or uniformly distributed perforations.

U.S. Pat. No. 4,274,211 discloses a shoe sole made of flexible rubber material with a non-slip profile. The sole includes a plurality of various sized projections or layered elements. The elements include surfaces which are made from materials that are slip resistant. In addition to being slip resistant, the structure and spacing of the projections prevents the accumulation of mud and other debris on the soles of the shoes.

U.S. Pat. No. 7,047,672 discloses a shoe sole which is designed to be used on a sand surface. The sole is made from a compressed material having an upper surface and a lower surface. A peripheral lip projects downwardly from the lower surface of the sole. A plurality of fins also project downwardly from the lower surface. This type of construction enables efficient propulsion in sandy environments.

U.S. Patent Application Publication No. 2009/0188132 discloses a slip resistant shoe sole which includes a plurality of ground contacting projections. The ground contacting projections are V-shaped and are spaced from one another by a predetermined distance in a longitudinal direction of the sole of the shoe. The V-shaped projections also include reinforcements at their base. The projections are made from an elastomeric polymer with a specific JIS-hardness. This material increases the shoe's ability to resist slipping, and the shape of the projections increase their resistance to avoid bending and deformation.

U.S. Pat. No. 7,703,221 discloses a sole assembly for a shoe which includes a flexible base having an underside surface which includes a forward region, a rearward region, and an intermediate region therebetween. The sole includes a plurality of individual sole elements on the underside thereof. Each element includes a body portion and a connecting section which are operatively secured to the underside surface of the flexible base. The sole elements are arranged on the underside surface of the flexible base such that adjacent sole elements have overlapping sections.

What is needed in the industry is an overshoe having a sidewall to allow expansion to accommodate a variety of shoe sizes while providing an outsole that allows an individual secure footing when traversing slick surfaces.

SUMMARY OF THE INVENTION

A slip resistant overshoe is disclosed having a sole with a flexible shank positioned between a toe section and a heel section. The sole is connected to an upper member having a front section spaced apart from a rear section with opposing side sections. Both the flexible shank and opposing side sections are formed from a corrugated shape consisting of a plurality of ridges and grooves. The corrugated shape is constructed and arranged to allow expansion between the toe section and the heel section. The expansion allows ease of inserting a variety of shoe sizes and types into the overshoe. The outsole includes a non-slip tread design, and the insole includes raised ridges to limit frictional attachment during installation.

An objective of the invention is to disclose a slip resistant overshoe having expansion sections to accommodate shoes of various sizes.

Another objective of the invention is to disclose an overshoe that allows expansion of the shank, wherein the overshoe has expansion, making it easier to insert a shoe and allow flexibly in the shank or midsole of the overshoe so that the flexibility of the installed shoe is not adversely affected.

Still another objective of the invention is to disclose an overshoe that allows expansion of a sidewall section to accommodate a greater range of shoe sizes using ridges and grooves that match the flexible shank, and then vary the height and width of the ridges and grooves not associated with the flexible shank.

Still another objective of the invention is to provide an overshoe having opposing side sections that are substantially V-shaped, providing a functional sidewall and aesthetically pleasing design.

Yet still another objective of the invention is to provide an overshoe having a flexible shank formed from a plurality of ridges and grooves having substantially the same height and width, and upon the stretching of the overshoe, a flatter surface is obtained, resulting in greater slip resistance.

Another objective of the invention is to provide an expandable shank and expandable upper member formed from a single molded member.

Still another objective of the invention is to provide a ribbed insole to assist during shoe installation, wherein the ribbed insole lessens frictional contact with the insole to ease installation.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENT

Figure 1:
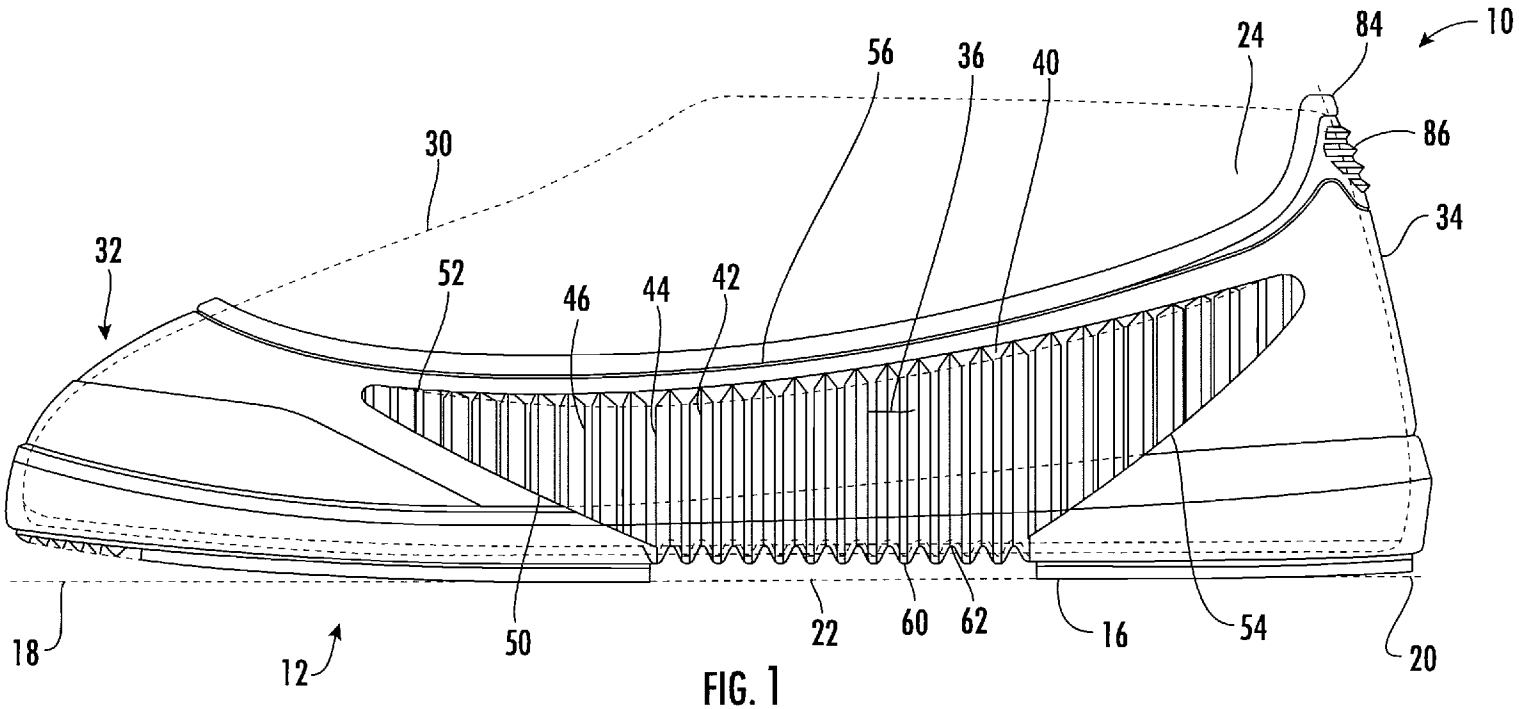
FIG. 1 is a partial cross sectional side view of the overshoe of the instant invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 2:
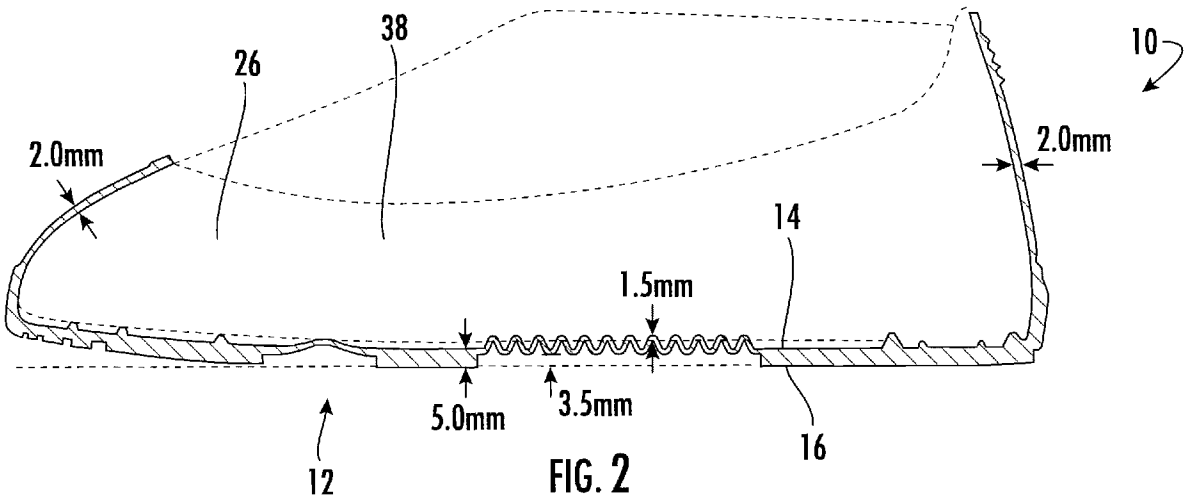
FIG. 2 is a cross sectional side view of the overshoe.
Figure 3:
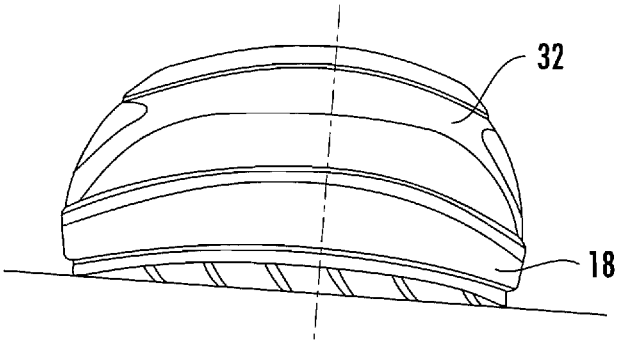
FIG. 3 is a bottom view thereof.
Figure 4:
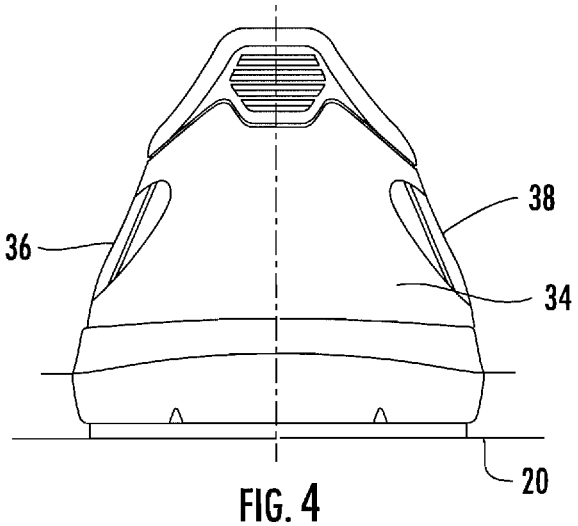
FIG. 4 is a heel view thereof.
Figure 5:
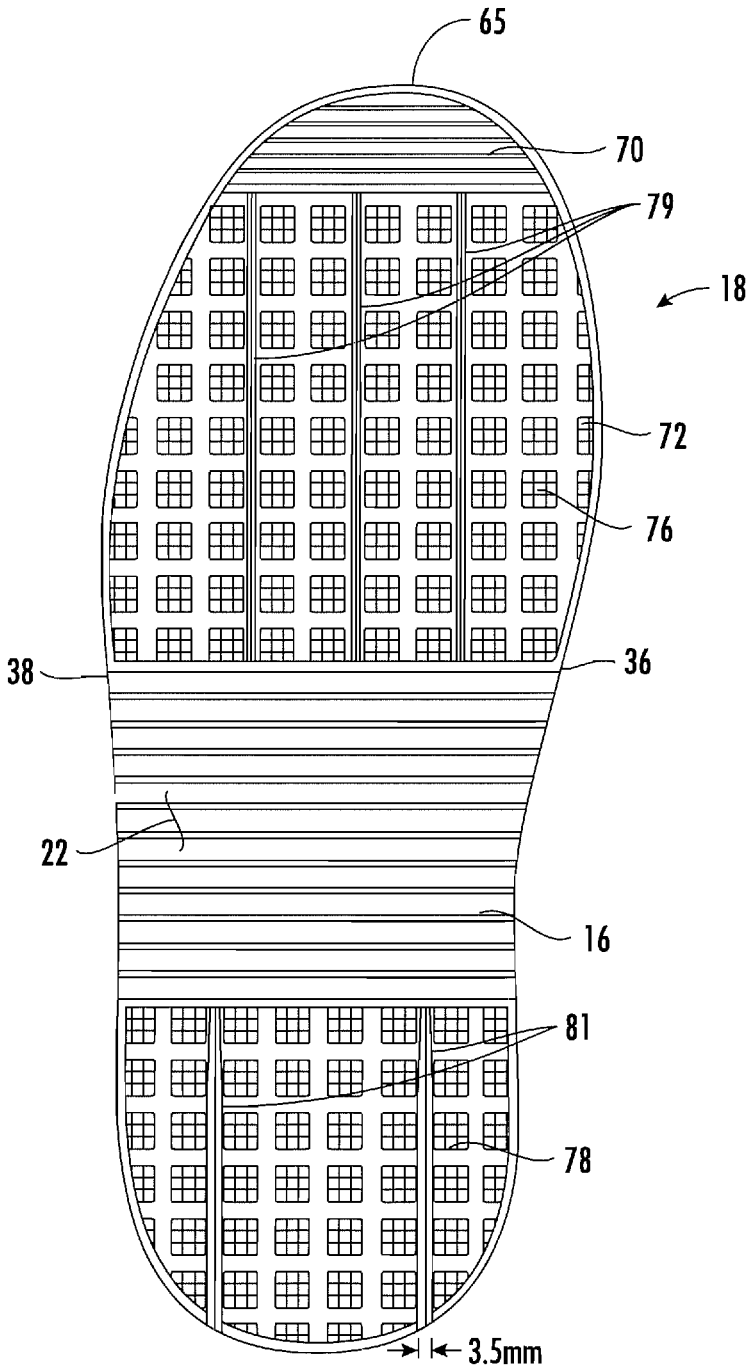
FIG. 5 is a bottom view of the overshoe with an example of a non-slip tread design.

Referring in general to the Figures, and in particular to FIGS. 1-2, disclosed is the slip resistant overshoe 10 having a sole 12 defined by an insole 14 and an outsole 16. The sole 12 is further bounded by a toe section 18 spaced apart from a heel section 20 by a mid-portion, referred to throughout this specification as a flexible shank 22. An upper member 24 is connected to the sole 12, either by weldment or by being formed from a single piece of material. The upper member 24 includes a front section 32 and a rear section 34 with opposing side sections 36 and 38 forming a cavity 26 for receipt of a shoe 30. The overshoe 10 can accept a variety of shoe sizes, as will be further described. Each said opposing side section 36, 38 includes a corrugated section 40 as illustrated by section 36 in FIG. 1, formed between the front section 32 and the rear section 34.

Figure 6:
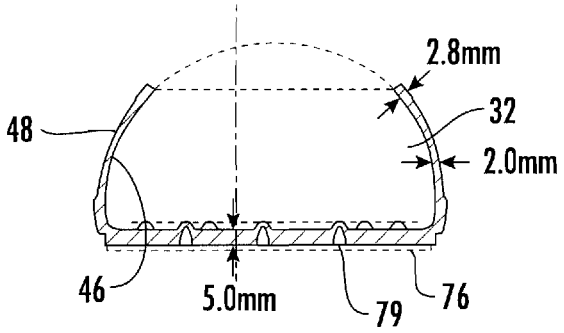
FIG. 6 is a cross section view taken along lines B1-B2 of FIG. 5.
Figure 7:
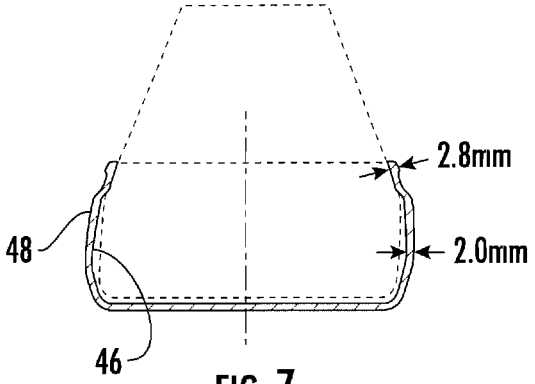
FIG. 7 is a cross section view taken along lines C1-C2 of FIG. 5.
Figure 8:
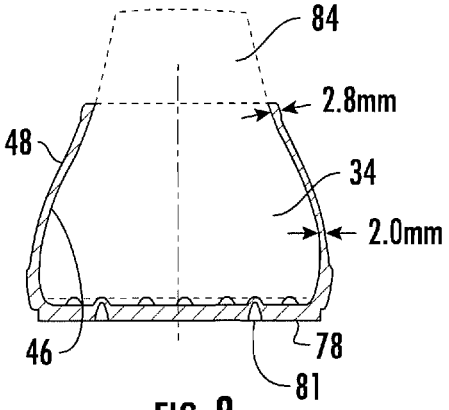
FIG. 8 is a cross section view taken along lines D1-D2 of FIG. 5.

The corrugated section 40 is further defined as a plurality of ridges 42 and grooves 44 extending between an inner surface 46 of the upper member 24 to an outer surface 48 of the upper member 24, as seen more clearly in FIGS. 6-8. Each side section 36, 38 is substantially V-shaped with the flexible shank forming a bottom of the section and extending from the flexible shank 22 toward the upper member front section 32 as bordered by front section edge 50, leading to upper section edge 52 beneath a connecting band 56 and bounded by a rear section edge 54 extending from flexible shank 22 toward the upper member rear section 34.

The connecting band 56 has a thickness of about 2.8 mm and is positioned between the front section 32 and the rear section 34 along the upper edge of each corrugated side section and allows controlled stretching during shoe installation, but is resistant to additional spacing once the ridges and grooves of the corrugated side sections have been fully expanded. The connecting band 56 operates to seal the overshoe to the shoe after installation by providing a smooth inner surface in close proximity to the installed shoe. In a preferred embodiment, the ridges 42 and grooves 44 of each corrugated side section 40 along the center portion of the overshoe 10 are matched with the ridges 60 and grooves 62 of the flexible shank. Expansion of this area is effortless since the ridges and grooves provide sufficient material to allow expansion of the length of the overshoe, with the connecting band 56 limiting expansion along the upper edge 52, and requiring stretching of the connecting band 56 if a further length is required. Similarly, the flexible shank 22 is formed from a plurality of ridges 60 and grooves 62 extending between the insole 14 and outsole 16. In the preferred embodiment, the flexible shank 22 is formed from ridges 60 and grooves 62 having substantially the same height and width. Further, where the flexible shank 22 meets the side wall sections 36 and 38, the ridges 60 and grooves 62 match, forming a U-shaped section having substantially the same height and width, allowing for a predetermined expansion. As with any rubber based overshoe, further stretching of the overshoe after expansion allows for insertion of an even larger size shoe. Further, in this application the stretching of the sole provides a flatter surface, resulting in a greater slip resistance.

The slip resistant overshoe is constructed from a unique slip resistant material. The slip resistant material has a hardness of about 0.49 Shore, based on tests performed on a Durometer Hardness Tester. The material also has a slip resistance rating of 0.56-0.65 when tested on a Brungraber Mark 2 Articulated Strut Slip Testing Device. A slip resistant surface is defined as a surface having a rating of 0.50 or higher when tested on the Brungraber Mark 2 Articulated Strut Slip Testing Device.

It is noted in this disclosure that the ridges 60 and grooves 62 allow for a predetermined expansion before stretching of the rubber material is required. This not only allows for ease of installation, but further allows for a larger range of shoe sizes that can be inserted into the cavity 26. The flexible shank 22 is constructed and arranged to allow expansion between the toe section 18 and the heel section 20 with corrugated sections, allowing controlled expansion of a predetermined distance between the front section 32 and the rear section 34. In the preferred embodiment, the sole 12 and the upper member 24 are molded as a single member. The average thickness of the upper member 24 is about 2 mm; the average thickness of the ridges and grooves is also about 2 mm.

Referring to FIGS. 3-8, the outsole toe section 18 includes a tip section 65 formed from ridges 70 positioned between the side walls 36 and 38. The ridges 70 provide toe traction. The remainder of the outsole forefront 72 is formed of a non-slip tread design 76. The tread design 76 depicted is particularly suited to work environments where the workers are required to traverse slick floor surfaces. The tread design 76 is formed from sipes 78 formed between square blocks of nine elements. The sipes 78 are used for squeegeeing and channeling liquid away from the tread to prevent slippage. The heel section 20 of the outsole 16 is also provided with sipes 78 which reduce or prevent both forward and sideways slippage of the footwear. Three channels 79 are formed along the toe section and two channels 81 are formed along the heel section. The channels expand and contract when an individual is walking, the expanding and contracting provides active cleaning of the channels by expelling debris. Each channel is about 3.5 mm wide and has a length that extends along the heel section and the toe section operate in combination with the sipes to maintain the slip resistance of the overshoe. Additional channels could be added to the heel and toe sections, illustrated is the preferred embodiment. The ability to expel debris provides an anti-clog function by causing debris to loosen and fall out. The anti-clog function maintains material slip resistance. The channels further allow expansion of the overshoe to permit ease of installation and removal.

As illustrated in FIGS. 6 and 8, the thickness of the treads is about 5 mm, in addition to the 2 mm upper member thickness. To assist in installing a shoe into the overshoe 10, a tab 84 is formed along the rear section 34, having gripping tabs 86 to allow frictional engagement of the tab 84.

Figure 9:
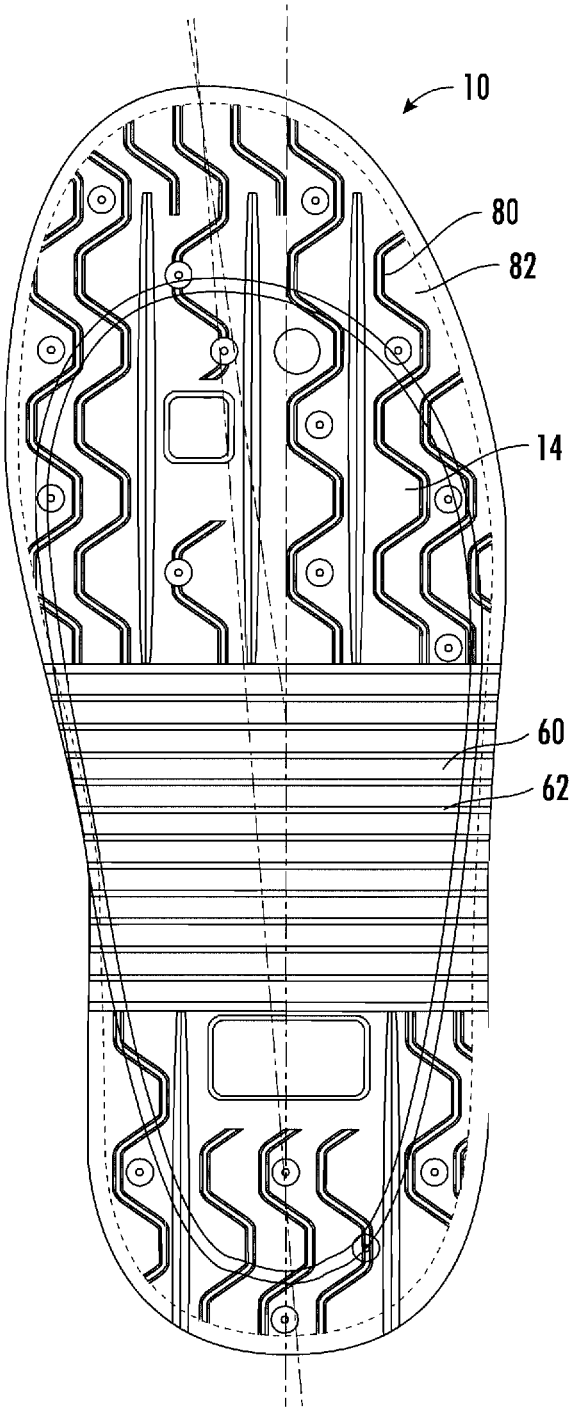
FIG. 9 is a top view, illustrating the insole, with the upper member removed.

Referring now to FIG. 9, the insole 14 of the overshoe 10 includes a plurality of raised ribs 80 providing spacing between the bottom of a shoe, not shown, and the inner surface 82 of the insole 14. The raised ribs 80 limit the contact of a shoe being inserted to the tops of the raised ribs 80. It is noted that both the outsole tread design and the material of construction provide for non-slip surfaces which can further inhibit the insertion of a shoe into the overshoe. As the non-slip material forms the inner surface 82 of the insole 14, limiting the contact of the shoe to the raised ribs 80 limits surface contact for ease of shoe insertion. As a benefit, the raised ribs 80 further provide a cushion to the individual, as the weight of an individual will compress the ribs 80 while standing or walking.

The overshoe of the present invention is a one piece slip resistant molded member defined by an upper member having a front section spaced apart from a rear section by opposing side sections and a sole member having a toe section positioned beneath the upper member and spaced apart from a heel section by a shank, the heel positioned beneath the rear section. The shank is formed of a plurality of ridges and grooves, the ridges and grooves extending along a portion of each side section, forming a continuous U-shaped corrugated section; wherein the shank and the opposing side sections are constructed and arranged to allow the stretching of a distance between the front section 32 and the rear section 34 and the toe section 18 and the heel section 20.

The overshoe has a corrugated section having a material thickness of about 1.5 mm thick formed from the ridges and grooves alternating between and inner surface 46 and an outer surface 48 about 5.0 mm width.

The ridges 60 and grooves 62 are constructed and arranged to have a diminishing width extending from a rear edge of the shank 22 towards the heel section 20, and from a front edge of the shank 22 towards the toe section 18. The heel section and the toe section are about 3.5 mm from a bottom surface of the shank 22. The toe section 18 is about 2.0 mm thick, and the heel section 20 is about 2.0 mm thick.

The overshoe ridges 60 and grooves 62 are constructed and arranged to stretch substantially the same across the shank and the opposing side sections 36, 38, and diminish in stretch along the corrugated section 40, extending from a rear edge of the shank 22 towards the heel portion 20, and diminish in stretch along the corrugated section 40 extending from a front edge of the shank 22 towards the toe section 16. The ridges 60 and grooves 62 can be of varying heights and widths.

A non-corrugated connecting band 46 extends between the front section 32 and the rear section 34 along an upper edge of each corrugated section, the connecting band 56 of a predetermined stretch length. The outsole of the toe section 16 and the heel section 18 include a non-slip tread design. The insole 14 includes raised ribs 80, allowing ease of shoe removal.

The term "about" means, in general, the stated value plus or minus 5%. The use of the word "a" or "an" when used in conjunction with the term "comprising" in the claims and/or the specification may mean "one," but it is also consistent with the meaning of "one or more" or "at least one." The use of the term "or" in the claims is used to mean "and/or" unless explicitly indicated to refer to alternatives only or the alternative are mutually exclusive, although the disclosure supports a definition that refers to only alternatives and "and/or."

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a method or device that "comprises," "has," "includes" or "contains" one or more steps or elements, possesses those one or more steps or elements, but is not limited to possessing only those one or more elements. Likewise, a step of a method or an element of a device that "comprises," "has," "includes" or "contains" one or more features, possesses those one or more features, but is not limited to possessing only those one or more features.

It is to be understood that while certain forms of the invention are illustrated, it is not to be limited to the specific forms or arrangements herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An overshoe comprising:

a one piece molded member defined by an upper member having a front section spaced apart from a rear section by opposing side sections, said side sections having a plurality of ridges and grooves, and a sole portion having a toe section positioned beneath said upper member and spaced apart from a heel section positioned beneath said rear section;

a shank having a plurality of ridges and grooves formed integral to said member and positioned between said toe section and said heel section, said shank and said side sections forming a continuous U-shaped corrugated section, said ridges and grooves are constructed and arranged to stretch substantially the same across said shank and said opposing side sections forming said corrugated section, and diminish in stretch along each said side section extending from a rear edge of said shank towards said heel portion, and diminish in stretch along said side section extending from a front edge of said shank towards said toe section;

wherein said corrugated section having ridges and grooves of equal shape that are constructed and arranged to allow the stretching of said member between said front section and said rear section and said toe section and said heel section.

2. The overshoe of claim 1 wherein said corrugated section having a material thickness of about 1.5 mm thick formed from said ridges and grooves alternating between an inner surface and an outer surface about 5.0 mm width.

3. The overshoe of claim 1 wherein said ridges and grooves on said side sections are constructed and arranged to have a diminishing width extending from a rear edge of said shank towards said heel portion, and from a front edge of said shank towards said toe portion.

4. The overshoe of claim 1 wherein each said shank is indented from said heel section and said toe section by about 3.5 mm.

5. The overshoe of claim 1 wherein each said toe section and said heel section is about 2.0 mm thick.

6. The overshoe of claim 1, wherein said ridges and grooves of said shank are of varying heights and widths.

7. The overshoe of claim 1 wherein including a connecting band extending between said front section and said rear section along an upper edge of each said side sections, said connecting band of a predetermined stretch length.

8. The overshoe of claim 1, wherein said toe section and said heel section include a non-slip tread design of a slip resistant material.

9. The overshoe of claim 8 wherein said slip resistant material has a hardness of about 0.49 Shore.

10. The overshoe of claim 8 includes a plurality of channels formed along said toe section and said heel section, each said channel is constructed and arranged to expand and contract to provide active cleaning of the channels by expelling debris for maintaining slip resistance of the overshoe.

* * * * *